US011337476B2

(12) United States Patent
Vorlop et al.

(10) Patent No.: US 11,337,476 B2
(45) Date of Patent: May 24, 2022

(54) WAISTBAND SYSTEM FOR GARMENTS

(71) Applicant: VANS, INC., Costa Mesa, CA (US)

(72) Inventors: Andrew M. Vorlop, Fountain Valley, CA (US); Colin C. O'Connor, Aliso Viejo, CA (US); Daniel J. Hernandez, Lakewood, CA (US)

(73) Assignee: Vans, Inc., Costa Mesa, CA (US)

( * ) Notice: Subject to any disclaimer, the term of this patent is extended or adjusted under 35 U.S.C. 154(b) by 149 days.

(21) Appl. No.: 15/842,736

(22) Filed: Dec. 14, 2017

(65) Prior Publication Data

US 2019/0183199 A1 Jun. 20, 2019

(51) Int. Cl.
*A41F 1/00* (2006.01)
*A41B 9/14* (2006.01)
(Continued)

(52) U.S. Cl.
CPC ..... *A41F 1/008* (2013.01); *A41B 9/14* (2013.01); *A41D 7/005* (2013.01); *A41B 9/004* (2013.01); *A41D 1/089* (2018.01)

(58) Field of Classification Search
CPC ..... A41B 9/004; A41B 9/14; A41D 1/089; A41D 7/005; A41F 1/008
(Continued)

(56) References Cited

U.S. PATENT DOCUMENTS 1,208,132 A * 12/1916 Gaines ..... A41D 1/21 2/221
1,797,115 A * 3/1931 Atkinson ..... A41F 9/02 2/401
(Continued)

FOREIGN PATENT DOCUMENTS

JP 54-164718 U 11/1979
JP 3025062 U 6/1996
(Continued)

OTHER PUBLICATIONS

"BP1Y Champro Performance Pull Up Baseball Pant Uniform Pants CH" (Amazon) May 21, 2020, retrieved from https://www.amazon.com/Champro-Performance-Baseball-uniform-Athletic/dp/B00WIS29JC/ref=sr_1_1?dchild=1&keywords=BP1Y+Champro+Performance+pull+up+baseball+pant+uniform+pants+ch&qid=1590084439&sr=8-1, entire document.
(Continued)

*Primary Examiner* — Tajash D Patel
(74) *Attorney, Agent, or Firm* — Smith, Gambrell & Russell LLP

(57) ABSTRACT

In certain embodiments, the inventive subject matter it is directed to a garment, e.g., boardshorts that includes pelvic and leg regions, the pelvic region being free of a fly structure in a fly region. A waistband system included at the top of the pelvic region for encircling the user's waist. The waistband system has an elastic housing configured to fully or partially encircle a user's waist, an elastically tensionable element having a portion slidably disposed in the housing and through an opening formed in the housing. A lock is associated with the tensionable element and the garment to allow for selective adjustment of tension in the tensionable element. The opening and lock are disposed off and away from the front pelvic region so that the front of the garment, or selected areas thereof, may have a flush finish.

12 Claims, 5 Drawing Sheets

(51) Int. Cl.
*A41D 1/089* (2018.01)
*A41D 7/00* (2006.01)
*A41B 9/00* (2006.01)

(58) Field of Classification Search
USPC ..... 2/228
See application file for complete search history.

(56) References Cited

U.S. PATENT DOCUMENTS 1,965,315 A * 7/1934 Mainzer ..... A41F 9/025 2/237
2,118,797 A * 5/1938 Sanders ..... A41F 9/02 2/237
2,206,505 A * 7/1940 Klein ..... A41F 9/02 2/237
2,223,621 A * 12/1940 Knappenberger ..... A41F 9/00 2/237
2,569,853 A * 10/1951 Grue ..... A41F 9/02 2/237
2,626,397 A * 1/1953 Lewis ..... A41D 1/06 2/237
2,684,486 A * 7/1954 John ..... A41F 9/02 2/221
2,983,924 A * 5/1961 Cohen ..... A41D 7/005 2/67
3,091,772 A 6/1963 Hebras
3,178,727 A * 4/1965 Neinken ..... A41F 9/02 2/237
3,638,242 A * 2/1972 Herter ..... A41D 1/06 2/237
3,703,729 A * 11/1972 Hinderer ..... A41F 1/008 2/237
3,784,986 A 1/1974 Klaproth
3,797,046 A * 3/1974 Hoch ..... A41F 1/008 2/237
3,835,473 A * 9/1974 Toyoda ..... A41D 1/06 2/237
3,887,968 A * 6/1975 Lynam ..... A41F 9/025 24/712
4,193,136 A * 3/1980 Pierce ..... A41F 9/02 2/237
4,477,928 A * 10/1984 Graff ..... D04B 1/18 2/221
4,480,339 A * 11/1984 Hubbard, Sr. ..... A41F 9/02 2/237
4,545,096 A * 10/1985 Belter ..... A41F 1/008 24/587.12
4,578,827 A * 4/1986 Appelt ..... A41F 1/008 2/221
4,596,055 A * 6/1986 Aach ..... A41F 9/025 2/237
4,780,939 A * 11/1988 Belter ..... A41F 1/008 24/191
4,918,790 A 4/1990 Cirket et al.
4,945,616 A * 8/1990 Okano ..... A41F 1/008 24/170
4,976,017 A * 12/1990 Frano ..... A41F 1/008 24/578.1
5,283,910 A 2/1994 Flint
5,375,266 A * 12/1994 Crisco ..... A41F 9/025 2/221
5,926,927 A * 7/1999 Winkler ..... A41F 1/008 24/593.1
6,081,930 A * 7/2000 Phillips ..... A41F 9/025 2/237
6,199,215 B1 3/2001 Biggerstaff
6,618,863 B2 * 9/2003 Blechman ..... A41F 9/025 2/108
6,665,913 B2 * 12/2003 Kosh ..... A44B 11/12 24/170
6,880,175 B2 * 4/2005 Tajima ..... A41F 9/025 2/221
7,174,574 B2 * 2/2007 Fontes ..... A41D 1/06 2/227
8,429,762 B2 * 4/2013 Weisman ..... A41D 7/00 2/237
8,850,619 B2 * 10/2014 Rush ..... A41D 1/089 2/228
8,910,317 B2 12/2014 Decker
9,198,475 B2 * 12/2015 Park ..... A41F 1/008
9,271,534 B2 3/2016 Geary
9,609,899 B1 * 4/2017 Gadler ..... A41D 13/012
10,299,524 B2 * 5/2019 Saturnio ..... A41F 9/025
10,306,932 B1 * 6/2019 Martin ..... A41B 9/14
2005/0283883 A1 12/2005 Fontes
2009/0007314 A1 1/2009 Beven
2009/0320182 A1 * 12/2009 Schmalz ..... A41F 9/02 2/237
2010/0229284 A1 * 9/2010 Wilson, II ..... A41D 1/08 2/237
2010/0275344 A1 * 11/2010 Demarest ..... A41F 9/025 2/237
2012/0096629 A1 * 4/2012 Swancutt ..... A41F 9/025 2/336
2013/0007947 A1 * 1/2013 Moore ..... A41F 9/02 2/236
2014/0182044 A1 * 7/2014 Cole ..... A41D 27/20 2/69
2015/0020286 A1 * 1/2015 Wilson, II ..... A41F 9/025 2/69
2015/0201682 A1 * 7/2015 Musciacchio ..... A41D 7/005 2/67
2017/0181483 A1 6/2017 Eisenhuth
2017/0290738 A1 10/2017 Evavold
2017/0325531 A1 * 11/2017 Lomax ..... A41F 9/025
2019/0021423 A1 * 1/2019 Fayle ..... A41F 9/025

FOREIGN PATENT DOCUMENTS

JP 2007-092258 A 4/2007
JP 3141210 U 4/2008
KR 10-2003-0058848 A 7/2003
WO 2016/196009 A1 12/2016

OTHER PUBLICATIONS

International Search Report and Written Opinion for PCT Application No. PCT/US18/65175, dated Mar. 21, 2019, 11 pages.
"BP1Y Champro Performance Pull Up Baseball Pant Uniform pants CH," retrieved from https://www.amazon.com/Champro-Performance-Baseball-uniforrn-pants/dp/BOOWIS14BG, Apr. 19, 2016, entire document.

* cited by examiner

WAISTBAND SYSTEM FOR GARMENTS

BACKGROUND

The inventive subject matter is generally directed to garments for the lower body, such as shorts, pants and knickers. The inventive subject matter is particularly directed to such garments adapted with closures suitable for aquatic sports and activities, such as surfing, paddling, and other board and paddle sports. The garments according to inventive subject matter have a waistband system that allows for the front of the garment to have a flush, non-bulging finish in at least the fly region, while allowing a secure fit on the user.

Known fly structures include fasteners, such as, zippers, drawcords, snaps, buttons, and hook and loop fasteners (e.g., Velcro®), and other closures or expandable gussets that allow for an opening or expansion of the front and create selectively openable or expandable based on vertically aligned edges or vertically oriented material overlaps over the fly region. (See, e.g., U.S. Pat. Nos. 6,199,215 and 7,174,574, and 9,271,534.) Unfortunately, such fly closures are not flush, i.e., level and non-bulging with the surrounding frontal area of the garment with the front panel. In boardshorts and aquatic garments, it is desirable, both from a functional and aesthetic perspective, for the fly to lie flat and neatly in the frontal region of the garment. However, conventional closures, such as mechanical fasteners, laces, overlapping materials, create a non-flush finish to the garment, i.e., one where there is a bulge or other protrusion. The waistband associated with conventional fly structures have waistband closure systems, such as buttons, snaps, and hook and loop fasteners, that allow the waist band to disengage from itself or separate to create a larger opening for a user to don or disrobe from the garment. Like fly structures, these waistband closures are disposed on the front of the garment and bulge or protrude.

The bulges or protrusions from the fly and associated waistband closure structures cause pressure points against the user's groin or other part of the pelvic region when the user presses against a hard surface, such as a surfboard, paddleboard, or other firm surface.

The conventional closures are often based on overlapping materials, i.e., non-coplanar materials in the area of overlap, that can separate under the force of waves and rivers or towed water sports. The force of the water or wind may cause the garment to come loose or even fall off during water-based or high-speed activities. Without the protection of the garment, the user's body may be exposed to forceful jets of water, which are potentially harmful. The opening of the garment or its unintended disrobing may compromise privacy and cause embarrassment.

The conventional fly closures, with their long seam lines and bulkiness, can also create a distracting visual that could be improved by a flush finish over the fly region.

The conventional waist closures, such as buttons, snaps, and hook and loop fasteners, can also create a distracting visual that could be improved by a flush finish over the front waist.

While fully elastic waistbands are known, which may address some of the foregoing problems, they are prone to overstretching and may not provide a secure, comfortable fit through a variety of activities, particularly aquatic sports.

Accordingly, there is a need for improved garments for aquatic and other activities that provide a waistband system that sufficiently secures a garment to the user during vigorous activities.

Accordingly, there is a need for improved garments for aquatic and other activities that provide a frontal region that does not have pressure points during use against firm surfaces.

Accordingly, there is a need for improved garments for aquatic and other activities that provide a frontal region that prevents accidental opening or disrobing during water sports and other vigorous activities.

Accordingly, there is a need for improved garments for aquatic and other activities that provide a frontal region that has a clean and attractive aesthetic.

SUMMARY

The inventive subject matter addresses the foregoing and other needs. The following embodiments are representative of how the inventive subject matter can address such needs.

In certain embodiments, the inventive subject matter it is directed to a garment, e.g., boardshorts that includes pelvic and leg regions, the pelvic region being free of a fly structure in a fly region. A waistband system included at the top of the pelvic region for encircling the user's waist. The waistband system has an elastic housing configured to fully or partially encircle a user's waist, an elastically tensionable element having a portion slidably disposed in the housing and through an opening formed in the housing. A lock is associated with the tensionable element and the garment to allow for selective adjustment of tension in the tensionable element. The opening and lock are disposed off and away from the front pelvic region so that the front of the garment, or selected areas thereof, may have a flush finish.

In the foregoing and other embodiments, the garment at least the region in the garment corresponding to a fly region has a flush finish. In the foregoing and other embodiments, a majority of the front of the pelvic region may have a flush finish.

In the foregoing and other embodiments, the housing may be configured to fully encircle a user's waist without any disengagable portion in at least the front pelvis region, thereby providing a flush finish to at least the front waistband region of the garment.

In the foregoing and other embodiments, the tensionable element may include an elastic portion coupled to an inelastic portion, those portions being slidably disposed in the housing, and the inelastic portion having a portion extendable through the opening.

In the foregoing and other embodiments, the opening and lock may be disposed on a left or right rear hip area.

In the foregoing and other embodiments, the body of the housing consists substantially of an elastic fabric so that the housing has elasticity over its length.

In the foregoing and other embodiments, the leg regions may be configured as shorts that have lower edges that are configured to be disposed above the knees of the intended user. In the foregoing and other embodiments, the shorts are boardshorts configured for a loose fit and relatively quick drying compared to natural fabrics like cotton, the board shorts having a body comprising a single ply of fabric comprising at least 5% elastane or triexta fibers.

In the foregoing and other embodiments, the garment's front pelvic region includes an elastic fabric. In the foregoing and other embodiments, at least the rear pelvic region includes an inelastic fabric. In the foregoing and other embodiments, the front pelvic region may have left and right quarter panels of an elastic fabric and the rear pelvic region may have left and right quarter panels of an inelastic fabric. In other embodiments, the rear pelvic region may have elasticity. In the foregoing and other embodiments, the left and right quarter panels may be a 2-way stretch elastic fabric that selectively stretches in the horizontal direction. In the foregoing and other embodiments, the leg and/or pelvic regions include an elastic fabric comprising an elastic thread, such as elastane, or a blend of elastic and inelastic threads that results in the fabric having overall elasticity during intended conditions of use. In the foregoing and other embodiments, the leg and/or the pelvic regions comprises an inelastic fabric comprising polyester or nylon or a blend of certain inelastic threads with certain other inelastic threads that results in a fabric having overall inelasticity during intended conditions of use.

In the foregoing and other embodiments, the tensionable element may include an elastic portion coupled to an inelastic portion, those portions being slidably disposed in the housing, and the inelastic portion extending through the opening, and wherein the inelastic portion has a first end anchored to a first anchor point, which may be adjacent the opening, an opposing, second end of the inelastic portion tunneling through the housing to the opening and extending therethrough and in slidable engagement with the lock, the second end returning back through the opening and into the housing, the second end coupling to a first end of the elastic portion, and a second, opposite end of the elastic portion being anchored to the garment at a second anchor point a predetermined distance from the opening such that tensioning of the adjustable element constricts the waistband system, placing it under elastic tension around the waist of the intended user.

In the foregoing and other embodiments, the garment's waistband system further comprises a second set of an opening and associated lock and tensionable element, like the first set described above, but in a second location on the garment, spaced off the front of the pelvic region.

In the foregoing and other embodiments, the lock may be a cam buckle.

In another possible embodiment, the tensionable element includes an elastic portion coupled to an inelastic portion those portions are slidably disposed in the housing, and the inelastic portion extends through the opening, and wherein the inelastic portion has a first end anchored to a first anchor point. An opposing, second end of the inelastic portion tunnels through the housing to the opening and extends therethrough and in slidable engagement with the lock, the second end being a free end extending from the lock. A first end of the elastic portion is anchored to the garment at a position spaced away from the opening, and a second, opposite end of the elastic portion is coupled to the inelastic portion at a position spaced apart from the anchored position of the first end such that tensioning of the tensionable element constricts the waistband system, placing it under elastic tension around the waist of the intended user.

In another possible embodiment of a tensionable element, the elastic portion is not anchored to the garment but is an intervening portion between inelastic portions, or a terminal end portion of the tensionable element, one end of the tensionable element being anchored to the garment and the other end routing through the housing and lock. Other embodiments are contemplated in the Detailed Description below, the appended Figures, and in the claims, as originally written or amended, the claims as such being incorporated by reference into this Summary. The foregoing is not intended to be an exhaustive list of embodiments and features of the inventive subject matter. Persons skilled in the art can appreciate other embodiments and features from the following detailed description in conjunction with the drawings.

BRIEF DESCRIPTION OF THE DRAWINGS

The following figures.

FIG. 1 shows a front view of a garment, in this case boardshorts, with an adjustable waistband system.

FIG. 2 shows a back view of the boardshorts of FIG. 1.

FIG. 3 shows a right-side view of the boardshorts of FIG. 1.

FIG. 4 shows a left-side view of the boardshorts of FIG. 1.

FIG. 5 shows a detailed cutaway view of the tensionable element in a housing of a waistband system of the boardshorts of FIG. 1.

FIG. 6 shows a view of details for the lock and associated tensionable element for a waistband system.

DETAILED DESCRIPTION

Figure 1:
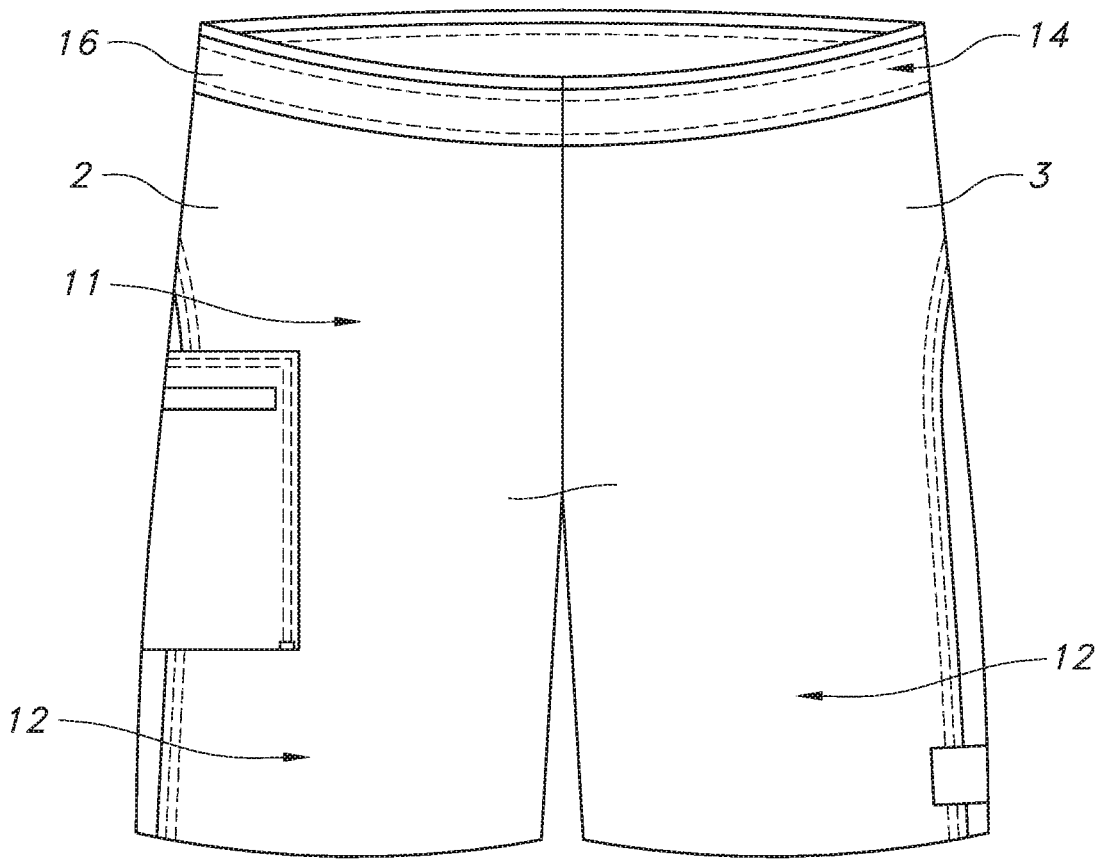
FIGS. 1-6, show one possible embodiment according to the inventive subject matter, unless noted as showing prior art. The figures presented are for illustrative and explanatory purposes and are not necessary in scale.

Representative embodiments according to the inventive subject matter are shown in FIGS. 1-6 or described herein, wherein the same or generally similar features sharing common reference numerals.

The inventive subject matter is generally directed to garments with an adjustable waistband having a front panel clear of fly, laces, zipper, or other bulging or protruding structures. For purposes of illustrating the inventive subject matter, without intending to limit its scope, a pair of boardshorts will be used as an exemplary embodiment. The waistband uses a lock, such as a cam buckle, located off the front of the shorts, e.g., on a side portion, to provide for locking adjustments of a tension element that is routed in the housing of the waistband, thereby keeping the front of the shorts clean and flush so that they do not create pressure points on a user and allow for a flush finish to at least the fly area of the front pelvic region of the shorts.

More particularly, the inventive subject matter is directed to a garment, e.g., boardshorts that includes pelvic and leg regions, the pelvic region being free of a fly structure in a fly region. A waistband system included at the top of the pelvic region for encircling the user's waist. The waistband system has an elastic housing configured to fully or partially encircle a user's waist, an elastically tensionable element having a portion slidably disposed in the housing and through an opening formed in the housing. A lock is associated with the tensionable element and the garment to allow for selective adjustment of tension in the tensionable element. The opening and lock are disposed off and away from the front pelvic region so that the front of the garment, or selected areas thereof, may have a flush finish.

As used herein, a "flush finish" means that the selected area is free of bulges and protrusions; it is integrally level, i.e., having at least an outer surface that is coplanar with the surrounding area of material to which it is joined when the material is laid flat. The selected area may be continuously integral by being made of sheet or ply of material that extends to the surrounding areas. Or it may be discontinuously integral by being made of, for example, multiple panels or sections of the same or different material that are joined together and are coplanar.

The following description and accompanying figures disclose an article of garment 1 having a representative configuration of a pair of boardshorts or water shorts that may be utilized for aquatic activities (e.g., swimming, surfing, paddling, snorkeling). In other configurations, garment 1 may have the structure of other types of shorts that are utilized during athletic activities, including basketball shorts, biking shorts, running shorts, soccer shorts, and swim suits, for example. Concepts associated with garment 1 may also be applied to any other garments where a secure flush finish is desired, including dress shorts, pants, skirts, slacks, knickers, tights, and other types of garments. Accordingly, the concepts associated with garment 1 may be applied to a wide range of garment styles or configurations that are used for both athletic and non-athletic activities.

Garment 1 generally includes a pelvic region 11 and a pair of leg regions 12. Pelvic region 11 has a configuration that substantially extends around and covers a pelvic area of an individual. As commonly known, there is an anterior or front pelvic region and a posterior or back pelvic region. Leg regions 12 extend downward from opposite sides of pelvic region 11 and have a configuration that substantially extends around and covers upper leg areas of individual. Garment 1 may also be defined by multiple zones or panels, e.g., panels 2, 3, 4, 6, across the front and rear portions of the garment, as discussed in more detail below Garment 1 has a main body, which generally defines each of regions 11 and 12, that may be formed from one or more textile elements. If the body is formed of multiple elements, the elements may be joined through, for example, stitching, adhesives, bonding, and/or thermobonding. Some or all the body of garment 1 may be a unitary, seamless construction based on known weaving and knitting techniques for producing three-dimensional configurations. In certain embodiments, the body of garment 1 is formed of one or more panels of drapable material that extend coplanarly around the parts of the body they surround. For example, multiple panels can be joined edge-to-edge to create a coplanar outer surface construction across multiple body regions, e.g., the front and rear pelvic regions. In other embodiments, a single sheet or ply of drapable material surrounds such multiple body regions in a seamless construction. Any given panel can be made of single ply of material or multiple plies that are laminated together, e.g., a laminate of a durable outer material and an inner comfort liner.

The textile elements used to form any portion of garment 1 may be formed from either 2-way or 4-way stretch textiles or non-stretch textiles. Although non-stretch textile elements may be utilized in garment 10, an advantage to stretch textile elements is that portions of regions 11 and 12 will selectively stretch or otherwise elongate to conform with movements of the user during aquatic or land-based activities, thereby providing less restriction and a greater freedom of movement during the activities. The textile elements may also be formed from either woven or knitted textiles. Although knitted textile elements may be utilized in garment 1, an advantage of woven textile elements relates to high durability and a low tendency to permanently deform when subjected to tensile forces (i.e., when stretched). A further advantage to woven textile elements, which benefits garment 1 having the configuration of boardshorts or water shorts, is that small spaces between yarns within the woven textile elements tend to hold a small quantity of water and exhibit little deformation because of being saturated with water. In some configurations, portions of garment 1 may also include various appliqués, transfers, patches, indicia, tags, pulls, grommets, or other aesthetic or functional features.

Pelvic region 11 includes a waistband system 14 that defines an upper opening out of which a torso area of a user extends. Except for waistband system 14, in the case of boardshorts, a majority of garment 1 typically has a loose-fitting configuration. That is, garment 1 is generally structured to be spaced from the user or in loose contact with the user when worn, rather than in tight-fitting contact with the user. The garment may optionally include one or more pockets, e.g., pocket 7, which may have a body that overlaps the body of the garment or is formed behind the body, with just a slot on the body surface for accessing the pocket. (The latter approach would leave the garment with a flush finish in the pocket area.)

FIG. 1 shows a front view of a pair of an exemplary garment, namely a pair of boardshorts 1. The shorts 1 include a front pelvic region having a flush finish, excepting any optional pocket formed on the surface. In this example, the front region has a waistband portion that extends across the front pelvic region. The front pelvic region includes a right front panel 2, a left front panel 3, a right rear panel 4, a left rear panel 5, and a waist area panel 6. At least the front waistband and the front panels are joined together with seams in a flush finish. The left and right front panels are adjacent to each other and disposed over the front of pelvic region 11. The front pelvic region is free of zippers, laces, gussets, buttons or other fly or waist closures that bulge and cause a non-flush surface with the general, front pelvic region (not counting any pockets that may be provided at the sides of the pelvic region). Although not shown, in other embodiments, the panels and waistband zone may be joined in a unitary, seamless construction. Consistent with the flyless embodiment, the waistband panel or zone may be a continuous, uninterrupted structure that does not disengage or separate from itself, as would be the case with a conventional waistband having waistband closure structure associated with a fly structure.

The boardshorts 1 may be constructed from any number of known textile materials. Example materials include a quick-dry type fabric, such as fabrics based on fibers of elastane, trixeta (e.g., Sorona brand fibers by DuPont), polyester, nylon, or fabrics having blends of such fibers, or lightweight neoprene. The boardshorts may be made in whole or part of elastic or inelastic material, with placement of selected materials in various arrangements. For example, boardshorts may be made with varying zones of elastic and inelastic materials. For example. Front, rear, waist and/or side zones may be made of an elastic fabric, such as a fabric having elastane or trixeta fibers, or elastic fiber blends. Suitable blends may have at least 2%, 5%, 7%, 10%, 15%, 20%, 25%, 30%, 35%, 40%, 50%, or thereabout any such value, elastic fibers. The remainder may be natural and/or synthetic fabric such as polyester, nylon, cotton, or wool. In certain embodiments, the blend has 5%-20% elastic fibers, of thereabout such range. In one suitable embodiment, one or more of panels mayconsist of a fabric blend that is 90% polyester fibers/10% elastic fibers, or thereabout such values). And one or more of the panels consist of a relatively inelastic material that may have at least 50% of polyester, nylon, cotton, or wool. In some embodiments, the garment includes one or more front panels and a waist panel that are inelastic and one or more rear panels that are inelastic. The elastic panels may be knit or woven 2-way or 4-way stretch materials, as noted earlier. The foregoing description is not intended to be limiting. For example, in other embodiments, all panels may be elastic or all panels may be inelastic. As used herein, elasticity and inelasticity are relative terms that mean there is or is not appreciable stretch during expected conditions of use as active bodywear.

Boardshorts 1 include a waistband system 14 that encircles the user and is integral with the front and back of pelvic region 11 disposed below the waistband system. Waistband system consists of three principal components: (i) a housing 16, (ii) a tensionable element 18 that is adjustable disposed in the housing; and (iii) a lock 20 associated with the housing that operatively engages and disengages the tension element to lock it in a selected state of adjustment. The waistband system advantageously includes an arrangement of in inelastic and elastic materials that allow for constant, selected tension of the waistband system around the user in use. In other words, the waistband can adjust to the user's movements, while maintaining a secure and comfortable fit. Accordingly, the waistband system may be referred to as providing selective elastic tension.

Housing 16 is a generally tubular configuration of textile or other flexible material. For example, the housing can be formed by folding an elongate piece of fabric over itself so that edges align and joining the edges and terminal ends via stitching or other joining technique noted earlier. In other embodiments, the housing 16 may be formed of two separate elongate pieces of fabric that have edges aligned and are joined along the aligned edges and their terminal ends. In other embodiments, housing 16 is unitary, tubular structure that is seamlessly woven or knitted. In any case, housing 16 may in turn be joined to the body of boardshorts 1 to form the top perimetrical portion of pelvic region 11. In the embodiment shown, but not necessarily in all embodiments, housing 16 encircles the pelvic region with a break that would allow portions of the waistband to disengage, or it may have a break that allows portions of the waistband to disengage, opening the waistband.

Tensionable element 18 is an elongate, tensionable structure that is disposed in housing 16, except for one or more extendable portions that extend from one or more slots or other openings 22 formed in the housing. An extendable portion may extend through an opening so that it can be associated with a user-operable lock 20. A user can interact with the tensionable element and lock, and set the waistband system in a desired state of adjustment and elastic tension. The tensionable element may be, for example, a band, web or bundle of flexible material. The tensionable element may include a plurality of segments that are coupled together in end-to-end fashion. The tensionable element, and portions thereof, may be made of woven or knitted webbing, leather strapping, a bundle of straps, cords, or cables, etc. Such structures can be made of any natural or synthetic materials or combinations thereof. The tensionable element advantageously may be a combination of inelastic and elastic sections. By using a combination of material, the waistband system provides a secure, comfortable elastically tensioned fit around the user. The combination of inelastic and elastic materials provides limits to elasticity so that there is a secure fit while allowing for some give during use.

To provide adjustability to a user's waist, as discussed in more detail below, a portion of tensionable element 18 is anchored to the housing or body of the garment. Another portion is spaced apart from the anchored portion, the spacing defining a theoretical length that the housing can be constricted. One or more openings in the housing allow an end portion or intermediate portion of the tensionable element to be accessed and to extend out of the housing. When the user accesses and pulls the tensionable element, the tension acts on the anchored portion, pulling it toward the opening and consequently constricting and cinching the housing. Accordingly, the extending portion corresponds to a length of adjustment—the waistband is constricted as the more of the tensionable element is pulled through the opening; the waistband is expanded as the extending portion is withdrawn into the opening. The tensionable element may be referred to as being slidably disposed in the housing. This means that there is relative movement of one or more points on the tensionable element relative to the housing. For example, the stretching of an elastic portion of the tensionable element results in a sliding movement of the stretching portion relative to the housing. An inelastic portion may slide relative to the housing without stretching.

In the embodiment shown, the tensionable element includes inelastic and elastic portions that are sequentially joined, i.e. segments or zones are joined end-to-end. The tensionable element has an inelastic portion, e.g., nylon webbing, 24 that has a first end portion 27 that is anchored to the housing 16 at an anchor point 26. Anchor point 26 is adjacent opening 22, which is behind the user's front, right hip bone in this embodiment. The webbing or other tensionable element may be anchored using bar tacking or other joining technique. A free end 28 of inelastic portion 24 extends a short way beyond the anchor point 26 and couples to lock 20. In the example shown, lock 20 is a cam buckle, and the free end 28 is formed into a closed loop through a first slot 30 and around a cross member 32 in the buckle. (See FIG. 6 for details of lock 20.)

On another side of anchor point 26, inelastic portion 24 tunnels through housing 16, across the user's front pelvic region, across the user's back, to and through opening 22. It is slidably coupled to the lock 20 via a second pair of slots 34, 36 and cross member 38. The second end 40 of inelastic portion 24 slidably loops through the second pair of slots 34, 36 so that it reverses direction and returns into opening 22. After it passes through opening 22 and back into the housing 16, it is sequentially joined or otherwise coupled to an elastic portion 42 of tensionable element 18. The elastic portion 42 tunnels through the housing, extending over a portion of the back of the user's waist, to an anchor point 43 on housing 16. That anchor point is on the left, rear side of the garment, approximately behind the left hip bone. In another possible embodiment (not shown), the waistband system is the same as waistband system 12 except that in the tensionable element, the second end 40 of inelastic portion 24 is sequentially joined or otherwise coupled to elastic portion 42 so that the end 40 extends through opening 22 and routes through a cam buckle such that end 40 is a free end that extends from the cam buckle and does not loop back into opening 22. In other words, inelastic portion 24 may be interrupted by an intervening elastic portion. The length of the extending free end is adjustable by opening or closing the cam buckle and pulling on the free end or allowing it to shorten due to the stored tension. The coupled elastic portion 42 will be tensioned accordingly, and the waistband system therefore operates in a similar manner as the embodiment illustrated in the Figures. In yet other embodiments, other arrangements of coupled inelastic and elastic portions in a tensionable element are possible. For example, the tensionable element may have multiple sets of an elastic portion inserted between and joined or otherwise coupled to inelastic portions. Further, the elastic portion may be the portion that routes through a lock 20 or at the anchor position by opening 22.

In another possible embodiment of a tensionable element, the elastic portion is not anchored to the garment but is an intervening portion between inelastic portions, or a terminal end portion of the tensionable element, one end of the tensionable element being anchored to the garment and the other end routing through the housing and lock.

The elastic portion 42 extends a predetermined distance from anchor point 43, towards opening 22, sufficient to provide an adjustable, secure, comfortable elastically tensioned fit around the user's waist, in combination with the adjustment of the inelastic portion using lock 20. Suitable lengths for the elastic portion 42 are from about 2 inches to about 18 inches. In certain embodiments, it may be from about 4 to about 10 inches. By configuring the elastic portion 42 with a desired amount of elastic play, while coupling with the inelastic portion 24, the waistband system can dynamically adjust to a user and, after adjustment, provide a range of elastic tension. However, the range may be limited so that the waistband of the garment is not overstretched during vigorous activities, which could accidentally cause partial or full disrobing during such use.

By providing an elastic or partially elastic construction for elastic housing 16 and for tensionable element 18, and by locating opening 22 and adjacent lock 20 off the front of the pelvic region, i.e., along the side to back of the pelvic region, the front pelvic region is free of a fly closure and can have a flush finish in whole or desired part.

Figure 2:
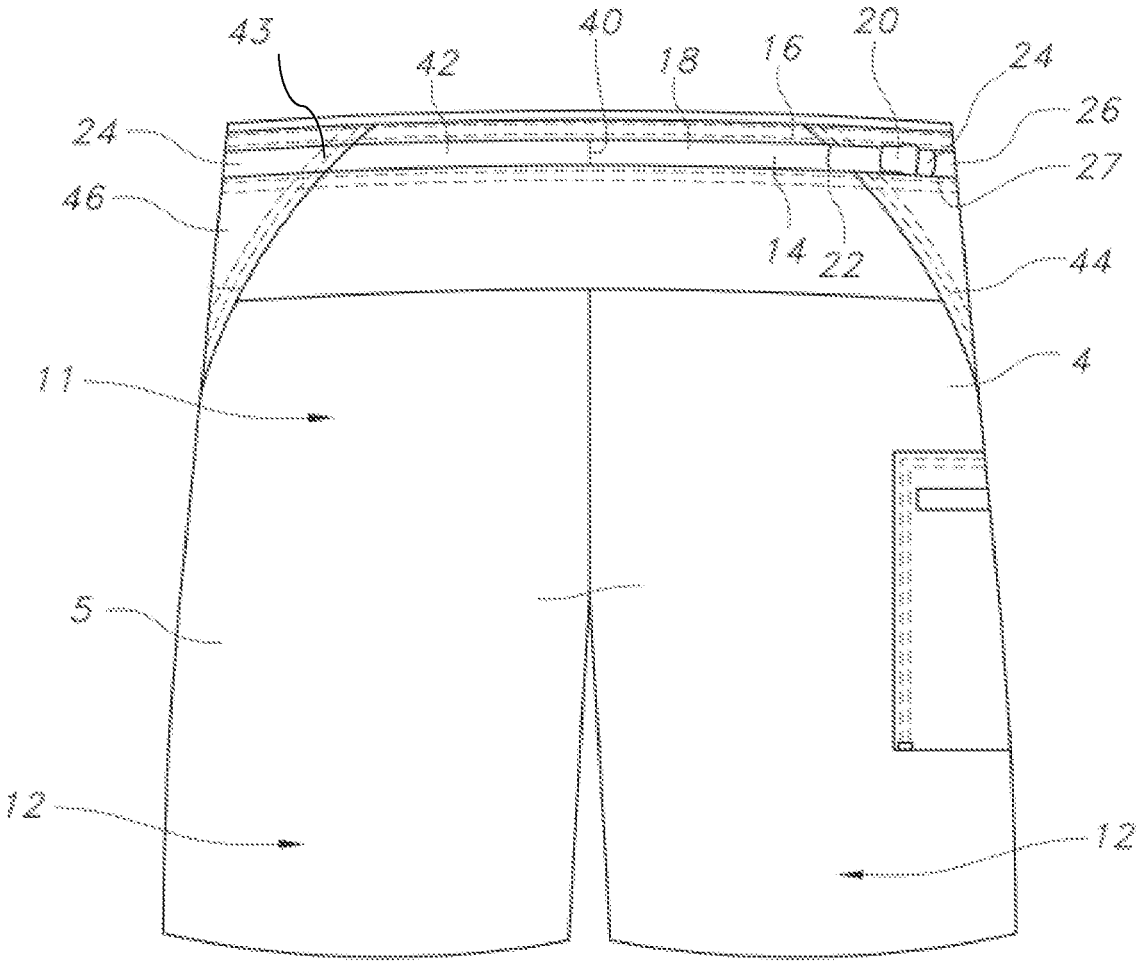
Figure 3:
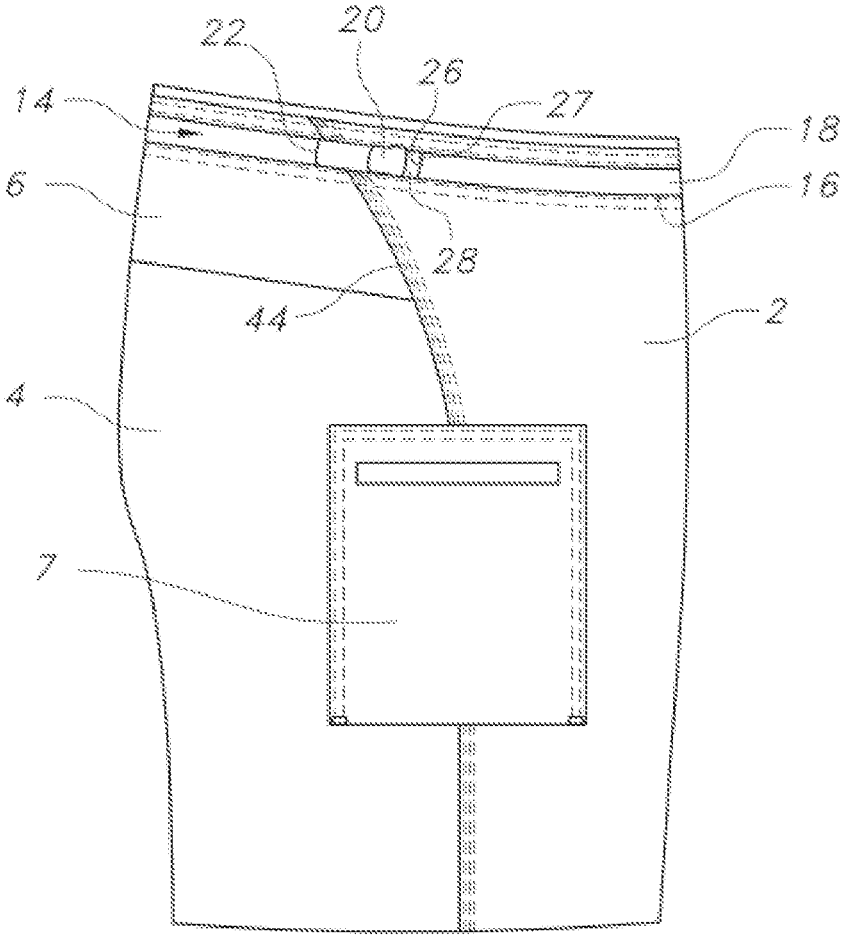
Figure 4:
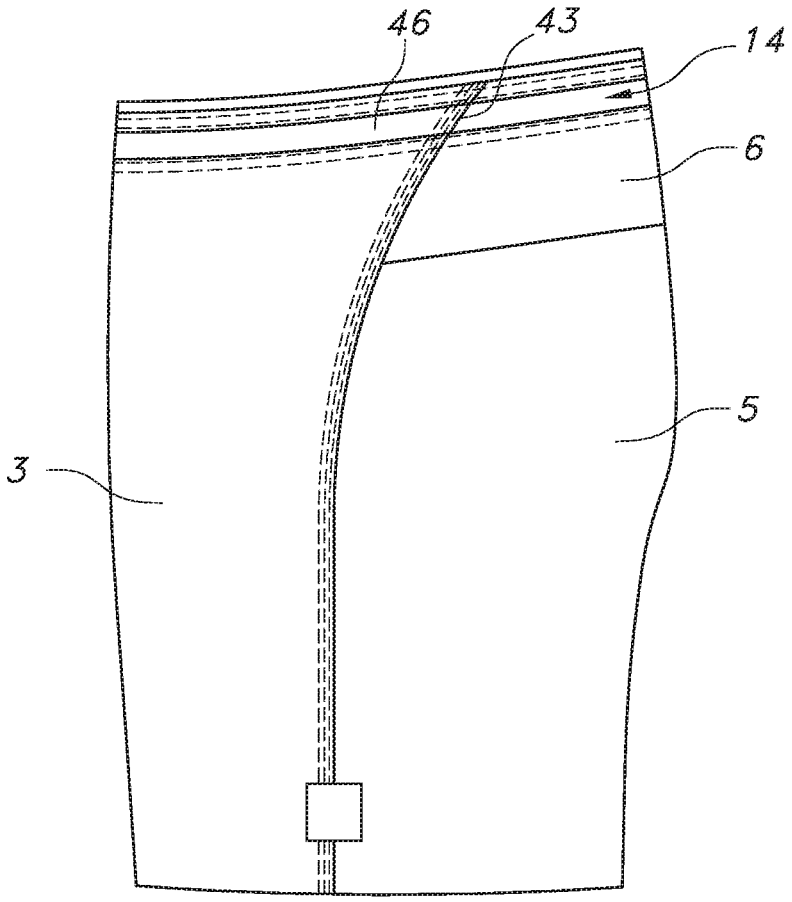
Figure 5:
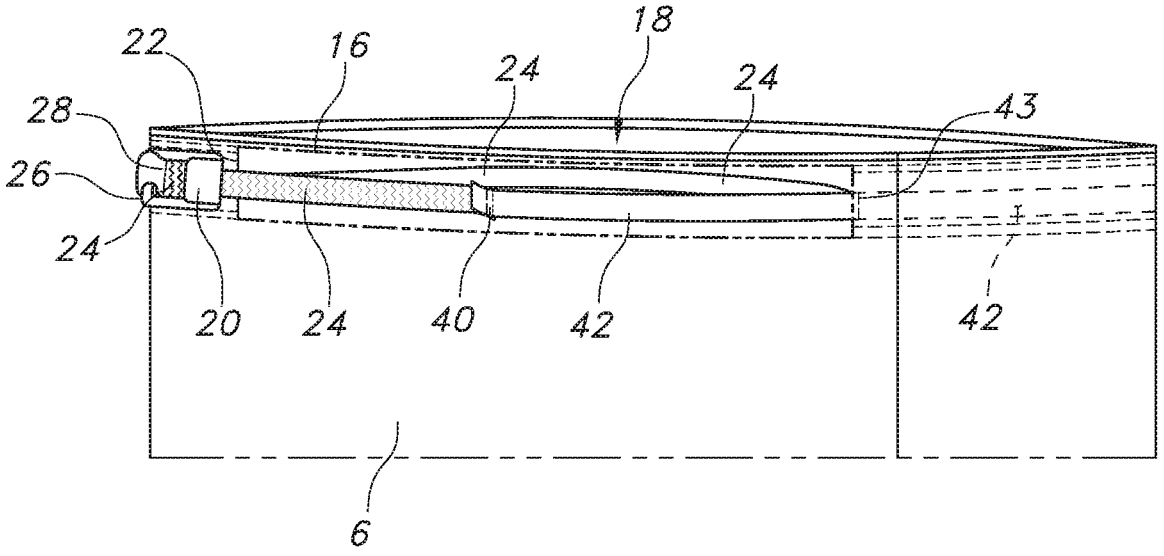
Figure 6:
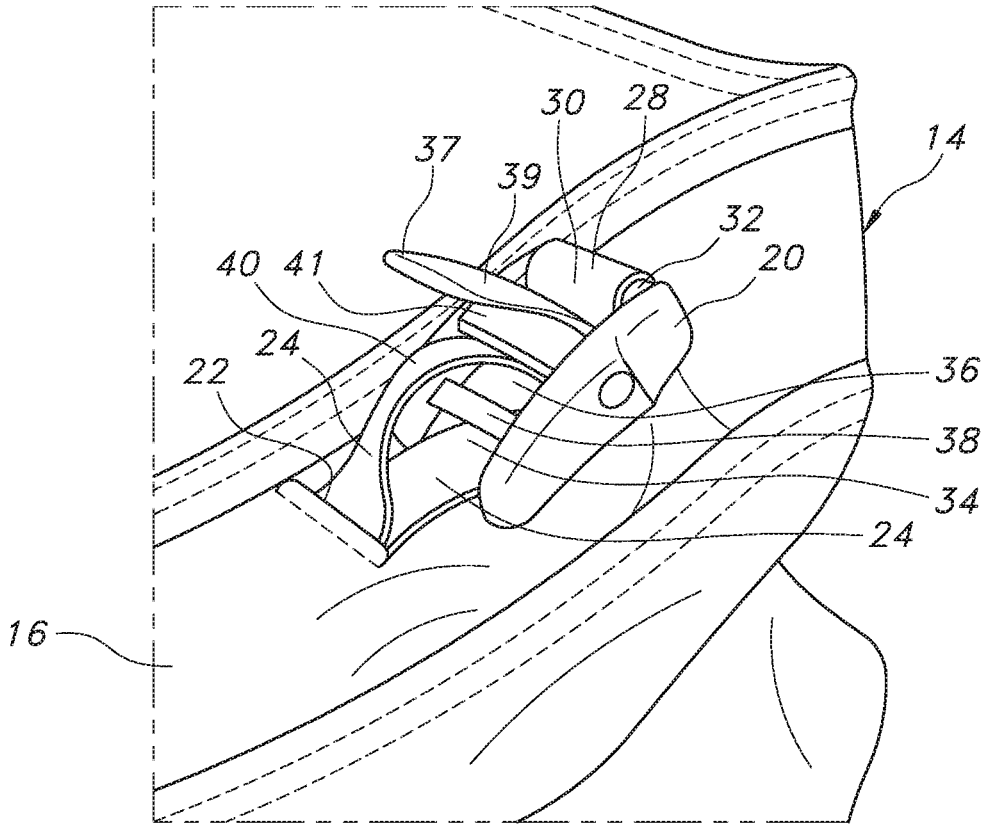

Looking particularly at FIG. 2, opening 22 is disposed at the right side of the user's back, behind the right hipbone. In this location, the user can readily access and pull the portion of tensionable element 18 that extends from opening 22, open or close lock 20, and thereby conveniently adjust the waistband system. The location is also off the side of the user's hip so that there are no pressure points if the user turns on his or her hip during use.

Persons skilled in the art will appreciate that the foregoing principles may be reflected in a variety of other embodiments. For example, the waistband system may have multiple segments and arrangements of elastic and inelastic materials, and it may have multiple openings, to allow for multiple adjustment points that are disposed off and away from the front of the garment. For instance, there could be a second adjustment opening with an associated adjustable portion of a tensionable element and lock disposed on the opposite of side of the user's body, behind the left hip.

As noted, lock 20 may be a cam buckle that consists of a pair of slots, through which a slidable portion of the tensionable element can be routed, along with a cam portion 37. The cam portion includes a latch 39 and a cam head 41. Cam head 41 is rotatable and selectively engages the tensionable element between the head and a cross member. Latch 39 extends from the head for the user to grasp and rotate the cam head between locked and unlocked positions. The foregoing is one possible version of a cam buckle, and, as persons skilled in the art will appreciate, other versions are known and possible. In addition to cam buckles, lock 20 can be any number of other buckles, clamps, or other locking systems for slidably engaging straps and the like, and selectively locking or unlocking the strap.

The exemplary boardshorts of the Figures have a multi-panel construction made up of left and right front quarter panels 2, 3 and left and right rear quarter panels 4, 5, which are joined together via generally vertical seams. The front quarter panels each have a small rearward extending portion 44, 46 that wraps around the back of the user's hips. The wrapping sections have a generally triangular shape on the back side of the shorts and they may overlap or merge with a horizontally extending waist area panel or zone 6 that may include or be connected to waistband system 14. However, the wrapping sections may have other shapes. The wrapping sections as continuation of the front panels would be made of the same material, for example, an elastic fabric.

The waist area panel or zone may fully or partially encircle the user. It, and any other panel or zone, may have the same or different material properties as adjacent zones. The waist panel or zone may connect to the quarter panels by generally horizontal seams. In one possible embodiment, the front quarter panels may be made of a 2-way stretch fabric that selectively stretches horizontally but is relatively inelastic vertically. The rear quarter panels may be made of a relatively inelastic fabric. The waist panel or zone, and included waistband system, are fully or partially elastic fabrics or materials so that they accommodate donning and disrobing of the garment, as well as accommodating user movement during use. As persons skilled in the art will appreciate, the foregoing is just one of many possible embodiments of the inventive subject matter, and it is not intended to limit the scope of the inventive subject matter.

TERMINOLOGY AND SCOPE

Persons skilled in the art will recognize that many modifications and variations are possible in the details, materials, and arrangements of the parts and actions which have been described and illustrated to explain the nature of the inventive subject matter, and that such modifications and variations do not depart from the spirit and scope of the teachings and claims contained therein.

The principles described above about any particular example can be combined with the principles described in connection with any one or more of the other examples. Accordingly, this detailed description shall not be construed in a limiting sense, and following a review of this disclosure, those of ordinary skill in the art will appreciate the wide variety of systems that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be plain to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more".

If and as used herein the terms "part", "portion", "segment", "region," "zone," "section" and like terms are generally synonymous terms and do not imply that something is or is not a discrete element or subcomponent in a larger construct or is or is not a non-discrete subdivision of a larger unitary construct, unless context indicates otherwise.

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

Each named inventor and the applicant reserve all rights to the subject matter disclosed herein, including the right to claim all that comes within the scope and spirit of the claims appended below. For any U.S. provisional application, each inventor and the applicant understand that claims are not a necessary component of a provisional patent application, and therefore detailed claims may not be included with any such application, and each inventor and the applicant reserve the right to pursue claims to any inventive subject matter disclosed or contemplated herein.

Currently claimed inventions:

1. A garment, comprising:

a pelvic region comprising a front portion and a rear portion, and leg regions, the pelvic region being free of a fly structure in a fly region;

a waistband system included at a top of the pelvic region configured to adjustably encircle a user's waist, the waistband system comprising an elastic housing configured to fully or partially encircle a user's waist, a tensionable element having a portion slidably disposed in the housing and extendable through an opening formed in the housing; and a lock associated with the tensionable element and the garment to allow for selective adjustment of tension in the tensionable element; and wherein the opening and lock are disposed on a left or right rear hip area of the rear portion of the pelvic region and wherein the tensionable element comprises an elastic portion coupled to an inelastic portion, the elastic portion and the inelastic portion being slidably disposed in the housing, and the inelastic portion having a portion extendable through the opening and the lock wherein the inelastic portion does not stretch when the elastic portion stretches under an elastic tension applied to the tensionable element.

2. The garment of claim 1 wherein at least the fly region has a flush finish.

3. The garment of claim 2 wherein a majority of the front portion of the pelvic region has a flush finish.

4. The garment of claim 2 wherein the housing is configured to fully encircle a user's waist.

5. The garment of claim 4 wherein a body of the housing consists essentially of an elastic fabric.

6. The garment of claim 1 wherein the leg regions are configured as shorts that have lower edges that are configured to be disposed above the knees of the intended user.

7. The garment of claim 6 wherein the shorts comprise boardshorts configured for a loose fit, the pelvic region, or the leg regions, or both comprising a single ply of quick-dry fabric comprising at least 5% elastic fibers.

8. The garment of claim 1 wherein the lock comprises a cam buckle.

9. The garment of claim 1 wherein the inelastic portion of the tensionable element has a first end anchored to a first anchor point, an opposing, second end of the inelastic portion tunneling through the housing to the opening and extending therethrough and in slidable engagement with the lock, the opposing end returning back through the opening and into the housing, the second end coupling to a first end of the elastic portion, and an opposite, second end of the elastic portion being anchored to the garment at a second anchor point a predetermined distance from the opening such that tensioning of the tensionable element constricts the waistband system, placing it under elastic tension when disposed around the waist of the intended user.

10. The garment of claim 1 wherein the leg regions, or the pelvic region, or both comprise an elastic fabric.

11. The garment of claim 10 wherein the rear portion of the pelvic region comprises an elastic fabric panel.

12. The garment of claim 1, wherein the tensionable element is elastically tensionable.

* * * * *